US008113682B2

(12) United States Patent
Bertken

(10) Patent No.: US 8,113,682 B2
(45) Date of Patent: Feb. 14, 2012

(54) MULTIPURPOSE WATERPROOF LIGHTING DEVICE WITH ELECTRONIC GLOW STICK

(75) Inventor: Dennis Bertken, Solana Beach, CA (US)

(73) Assignee: Life+Gear, Inc., Del Mar, CA (US)

( * ) Notice: Subject to any disclaimer, the term of this patent is extended or adjusted under 35 U.S.C. 154(b) by 128 days.

(21) Appl. No.: 12/716,211

(22) Filed: Mar. 2, 2010

(65) Prior Publication Data

US 2010/0157582 A1 Jun. 24, 2010

Related U.S. Application Data

(63) Continuation-in-part of application No. 12/244,663, filed on Oct. 2, 2008, now Pat. No. 7,845,820.

(51) Int. Cl.
*F21V 1/00* (2006.01)

(52) U.S. Cl. ..... 362/217.01; 362/120; 362/158; 362/202; 362/227; 362/249.02; 362/186; 362/205

(58) Field of Classification Search ..... 362/120, 362/157, 202, 205, 217.01, 227, 230–231, 362/249.01–249.02, 158, 186, 267
See application file for complete search history.

(56) References Cited

U.S. PATENT DOCUMENTS

| | | | |
|---|---|---|---|
| 2,340,530 | A | 2/1944 | Hefner |
| 4,249,234 | A | 2/1981 | Park et al. |
| 4,697,228 | A | 9/1987 | Mui et al. |
| 4,744,013 | A | 5/1988 | Lee et al. |
| 5,079,679 | A | 1/1992 | Chin-Fa |
| 5,412,548 | A | 5/1995 | Yee |
| 5,622,423 | A | 4/1997 | Lee |
| 5,735,594 | A | 4/1998 | Own |
| 5,806,961 | A | 9/1998 | Dalton et al. |
| 5,860,729 | A | 1/1999 | Bamber |

(Continued)

FOREIGN PATENT DOCUMENTS

CN 2 514 455 Y 10/2002

(Continued)

OTHER PUBLICATIONS

Supplementary European Search Report for European Application EP 08 82 5096, 3 pages, mailed Mar. 31, 2011, The Hague, Netherlands.

(Continued)

*Primary Examiner* — Stephen F Husar
*Assistant Examiner* — Meghan Dunwiddie
(74) *Attorney, Agent, or Firm* — Marger Johnson & McCollom, P.C.

(57) ABSTRACT

A lighting device comprises an elongated assembly forming a water-tight chamber adjacent a first end of the lighting device, where the first end includes a transparent face along a long axis of the elongated assembly. A lighting module, having a first light source and a second light source positioned on opposite ends of the lighting module, is positioned within the water-tight chamber so that the first light source is adjacent to and is configured to project light out the transparent face in a first direction along the long axis of the elongated assembly. The second light source is configured to illuminate along an elongated portion of the elongated assembly, where the elongated portion extends from the water-tight chamber in a second direction along the long axis of the elongated assembly opposite from the first direction, and out translucent circumferential sides of the elongated portion. A button on the module allows one to selectively alternate between the first and second light sources.

18 Claims, 6 Drawing Sheets

U.S. PATENT DOCUMENTS

| | | | |
|---|---|---|---|
| 5,879,076 | A | 3/1999 | Cross |
| 5,980,063 | A | 11/1999 | Ford et al. |
| 6,179,431 | B1 | 1/2001 | Chien |
| 6,213,623 | B1 | 4/2001 | Campman |
| 6,231,207 | B1 | 5/2001 | Kennedy et al. |
| 6,371,625 | B2 | 4/2002 | Campman |
| 6,623,140 | B2 | 9/2003 | Watterson et al. |
| 6,722,771 | B1 | 4/2004 | Stephens |
| 6,942,362 | B1 | 9/2005 | Deutsch et al. |
| 7,140,746 | B2 | 11/2006 | Chen |
| 7,198,382 | B2 | 4/2007 | Donovan |
| 7,267,453 | B2 | 9/2007 | Chang et al. |
| 7,347,581 | B2 | 3/2008 | Krieger |
| 7,566,157 | B2 | 7/2009 | Lo |
| 2001/0015893 | A1 | 8/2001 | Campman |
| 2002/0149928 | A1 | 10/2002 | Watterson et al. |
| 2002/0196622 | A1 | 12/2002 | Klees |
| 2004/0264172 | A1 | 12/2004 | Roberts |
| 2005/0046582 | A1 | 3/2005 | Kessel et al. |
| 2006/0082988 | A1 | 4/2006 | Riblett et al. |
| 2006/0203478 | A1 | 9/2006 | Waters |
| 2006/0221605 | A1 | 10/2006 | Theriault |
| 2007/0019398 | A1 | 1/2007 | Chen et al. |
| 2007/0153512 | A1 | 7/2007 | Hendrie |
| 2008/0094822 | A1 | 4/2008 | Hsu |
| 2008/0304258 | A1 | 12/2008 | McMillan et al. |
| 2010/0027249 | A1 | 2/2010 | Connor et al. |
| 2010/0157582 | A1 | 6/2010 | Bertken |

FOREIGN PATENT DOCUMENTS

| | | | |
|---|---|---|---|
| CN | 2842604 | | 11/2006 |
| EP | 0 921 345 | A2 | 6/1999 |
| EP | 746718 | | 11/2001 |
| GB | 2353853 | | 7/2001 |
| JP | 42-15593 | | 5/1971 |
| JP | 53-149483 | | 11/1978 |
| JP | 3095393 | | 7/2003 |
| WO | 00/45086 | A1 | 8/2000 |
| WO | 01/61238 | | 8/2001 |
| WO | 05073616 | | 11/2005 |

OTHER PUBLICATIONS

International Search Report and Written Opinion for PCT Application No. PCT/US2011/026735, 13 pages, mailed Apr. 26, 2011, Alexandria, Virginia, USA.

International Search Report and Written Opinion for PCT Application No. PCT/US2011/026738, 11 pages, mailed Apr. 26, 2011, Alexandria, Virginia, USA.

MULTIPURPOSE WATERPROOF LIGHTING DEVICE WITH ELECTRONIC GLOW STICK

CROSS REFERENCE TO RELATED APPLICATIONS

This application is a continuation-in-part of U.S. patent application Ser. No. 12/244,663, filed Oct. 2, 2008, now U.S. Pat. No. 7,845,820, issued Dec. 7, 2010, the disclosure of which is herein incorporated by reference.

BACKGROUND OF THE INVENTION

This invention relates generally to lighting sources and more particularly to a light source with flashlight and glow stick function that is structured to be used in a water-intensive environment.

Portable lighting is typically designed with the task in mind. Accordingly, flashlights are designed to focus a beam of light for peering into dark corners or cast light longer distances whereas lanterns are designed to cast light short distances but in all directions. One such general lighting source is the chemical-based glow stick. The glow stick embeds two or more chemicals within a hollow plastic tube that, when combined, fluoresce for a brief period of time. To use the glow stick, the tube is bent so that a capsule containing one of the chemicals is broken. The tube is shaken to mix the two chemicals and start the fluorescence process. Light from this process is radiated out the sidewalls of the tube in all directions.

One alternate solution would be to replace the chemical-based glow stick with an electronic one, using batteries, lamps, and associated circuitry. A problem may occur, however, when such electronic devices are used in a water-intensive environment. That is, water may enter the battery compartment and cause short-circuits, or alternately rust electronics controlling the device.

Accordingly, there is a need for a multifunction lighting device that is hardened against water intrusion and capable for use in high pressure situations without rupturing.

SUMMARY OF THE INVENTION

In various representative aspects, the present invention describes a multipurpose lighting device having a water-tight chamber for maintaining the illumination electronics therein.

A lighting device comprises an elongated assembly forming a water-tight chamber adjacent a first end of the lighting device, where the first end includes a transparent face along a long axis of the elongated assembly. A lighting module, having a first light source and a second light source positioned on opposite ends of the lighting module, is positioned within the water-tight chamber so that the first light source is adjacent to and is configured to project light out the transparent face in a first direction along the long axis of the elongated assembly. The second light source is configured to illuminate along an elongated portion of the elongated assembly, where the elongated portion extends from the water-tight chamber in a second direction along the long axis of the elongated assembly opposite from the first direction, and out translucent circumferential sides of the elongated portion. A button on the module allows one to selectively alternate between the first and second light sources. A water-tight interface is coupled within the open end of the module housing and interposed between the module housing and the elongated portion of the lighting device, where the interface includes a transparent wall along the long axis of the elongated assembly and adjacent the second light source.

In another aspect of the invention, the lighting device comprises a first part defined along a long axis of the lighting device. The first part includes a unitary module housing having circumferential side walls surrounding the long axis and a transparent face intersected by the long axis at a terminal end of the device, where the side walls and transparent face define a cavity within the module housing. A second part of the lighting device includes a substantially translucent body joined coaxially with the first part to form a water-tight seal therebetween and define the cavity substantially within the first part. An integrated module, installed substantially coaxially within the cavity, comprises a power storage part, a first light source configured to direct light in a first direction along an axis of and out the first part, and a second light source configured to direct light in a second direction along an axis into the interior of and out the second part, wherein the first direction and second direction are coaxial and in opposite directions. The second light source and second part are configured so that the substantially translucent body of the second part is illuminated by the second light source along a length and about a circumference of the second part.

The foregoing and other objects, features and advantages of the invention will become more readily apparent from the following detailed description of a preferred embodiment of the invention that proceeds with reference to the accompanying drawings.

DETAILED DESCRIPTION

Figure 1:
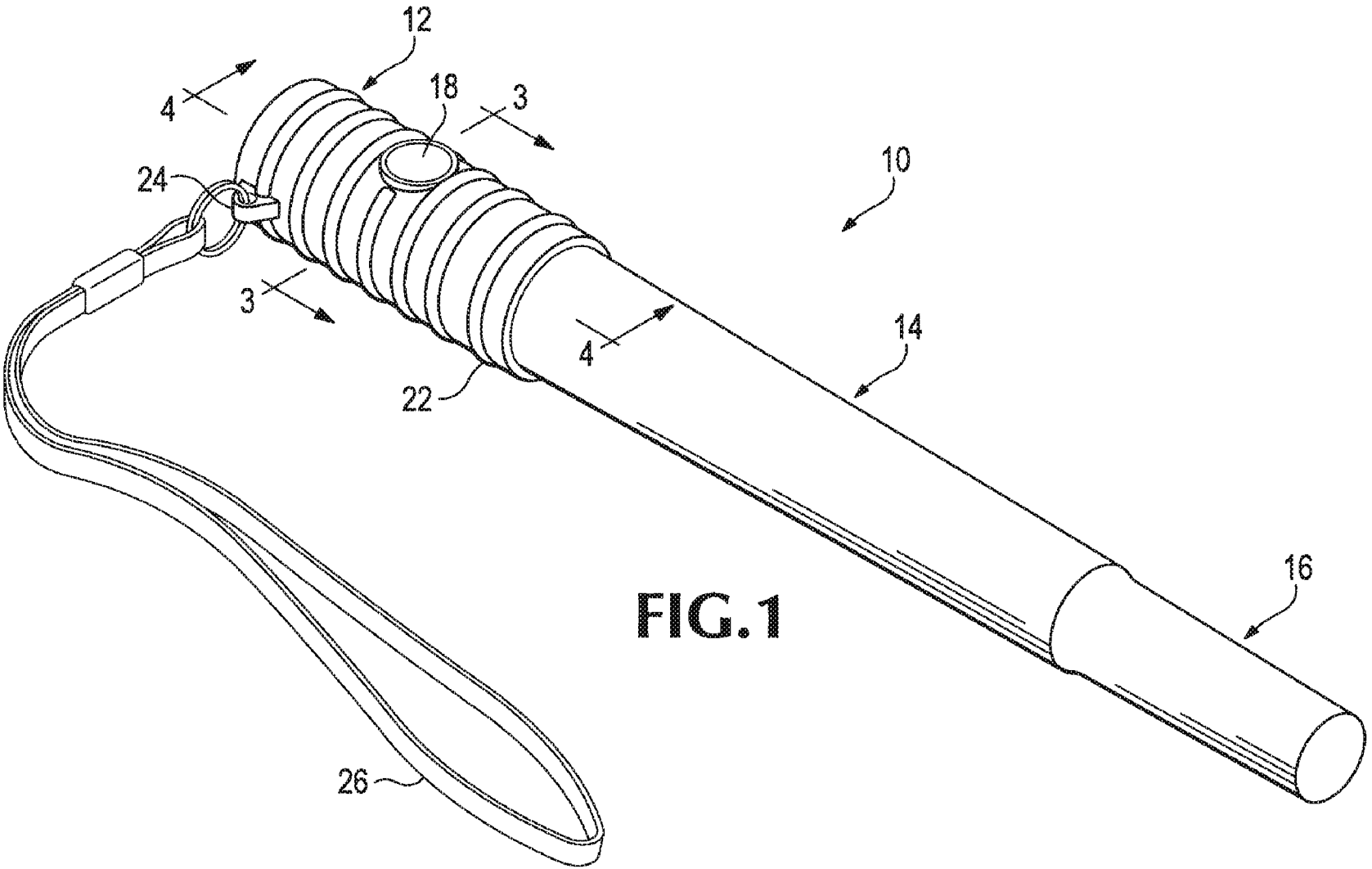
FIG. 1 is a perspective view of a multifunction lighting device according to one embodiment of the invention.

FIG. 1 illustrates a multipurpose lighting device 10 according to one embodiment of the invention. Device 10 is comprised of a device body having a flashlight housing 12, a glow stick housing 14, and an end cap 16 adjacent one end of the glow stick housing 14.

A button 18 is defined on a surface of the flashlight housing 12 and interfaces with a button on a lighting module 20 (FIG. 2) as will be described further below. The flashlight housing includes multiple ribs 22 running about the circumference of the housing 12. A flange 24 is fixed at an end of the flashlight housing 12 and couples with a detachable wrist strap 26.

Figure 2:
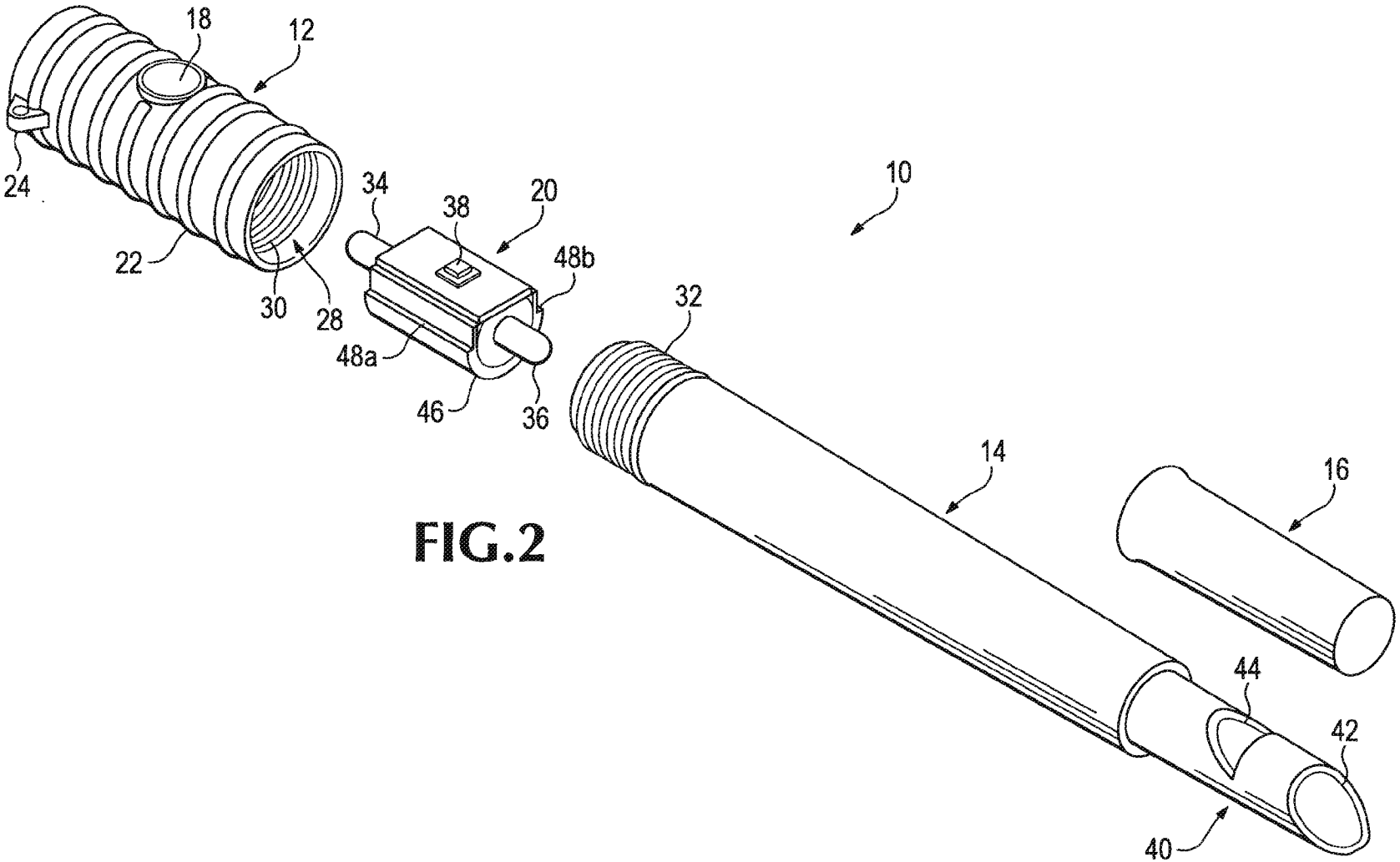
FIG. 2 is a perspective view of the lighting device of FIG. 1 shown in exploded view so that all components are illustrated.

As illustrated in FIG. 2, the flashlight housing 12 defines a hollow interior 28 into which the lighting module 20 is installed. Female threads 30 formed on the inside walls of the hollow interior 28 mate with male threads 32 formed on the end of the glow stick housing 14, thereby enclosing the interior 28 and fixing the lighting module 20 within the lighting device 10.

The lighting module includes two opposable light sources, shown by flashlight LED 34 and glow stick LED 36. Both light sources 34, 36 are actuated by a button 38 formed on the lighting module that, itself, is aligned with and actuated by the button 18 formed on the flashlight body 12.

FIG. 2 shows the end cap 16 removed from the end of the glow-stick housing 14. A whistle 40 is formed on the end and includes a mouthpiece opening 42 and whistle opening 44 separated by a shaped baffle (not shown) that completes the whistle. As will be appreciated, the multipurpose lighting device 10 includes a flashlight function, a lantern or glow stick function, and a whistle function. The device thus provides a useful multipurpose tool for emergencies or just general use.

Figure 3:
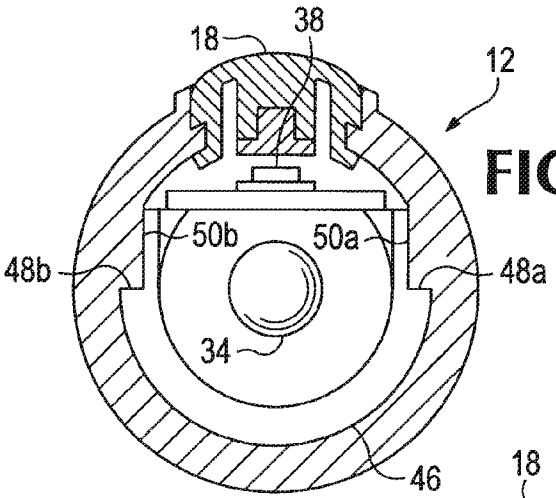
FIG. 3 is a front-section view taken along line 3-3 in FIG. 1 illustrating the lighting module installed within the body of the multipurpose lighting device of FIG. 1.
Figure 4:
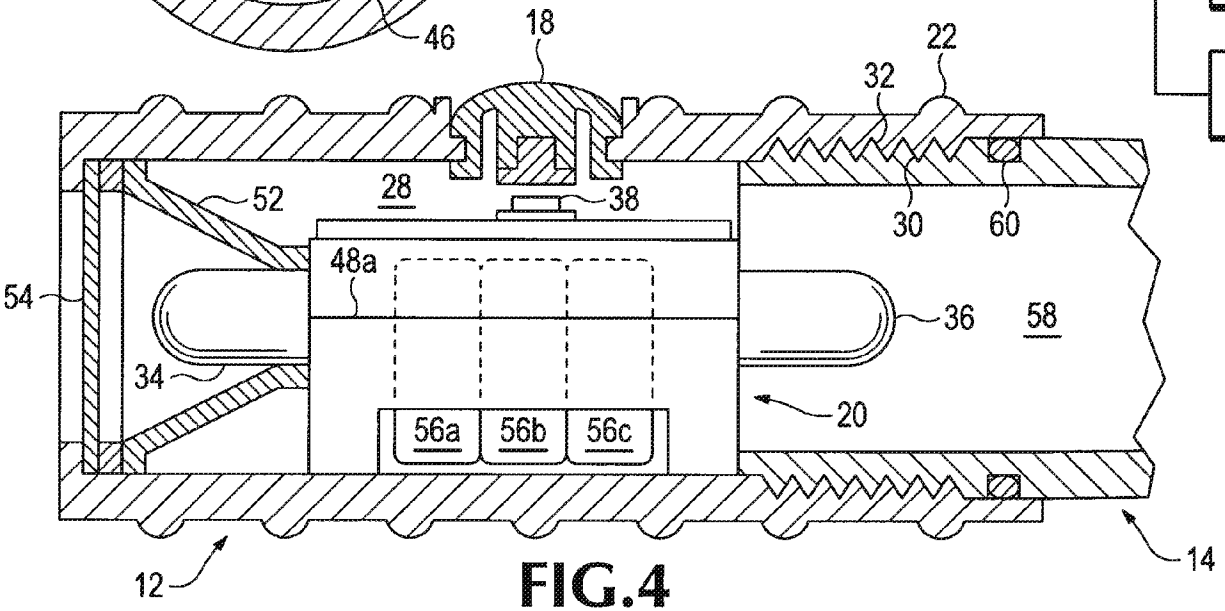
FIG. 4 is a side-section view taken along line 4-4 in FIG. 1 illustrating the lighting module installed within the body of the multipurpose lighting device of FIG. 1.

Turning to FIGS. 3 and 4, the lighting module 20 is shown installed within the flashlight housing 12 of the device 10. Module 20 includes a rounded lower end 46 terminating in elongate ridges 48*a*, 48*b* running the length of the module. Complementary molded portions 50*a*, 50*b* formed on inside walls of the cavity 28 are slidingly engaged with the ridges 48*a*, 48*b* when the lighting module 20 is installed. The cavity 28 of the flashlight housing is thus shaped by the molded portions 50*a*, 50*b* and by the dimensions of the cavity to locate the lighting module at a specific point so that (a) the lighting module button 38 is aligned with the button 18 formed on the outside of the flashlight module 12, and (b) the flashlight LED 34 inserts properly within a conical reflector 52 so that the light may be focused and projected outward through a forward-facing lens or transparent front 54. A power source, such as batteries 56*a*, 56*b*, and 56*c*, is installed within the lighting module to power the LEDs 34, 36 and electronics necessary to selectively actuate the lights according to the flowchart of FIG. 5.

Figure 5:
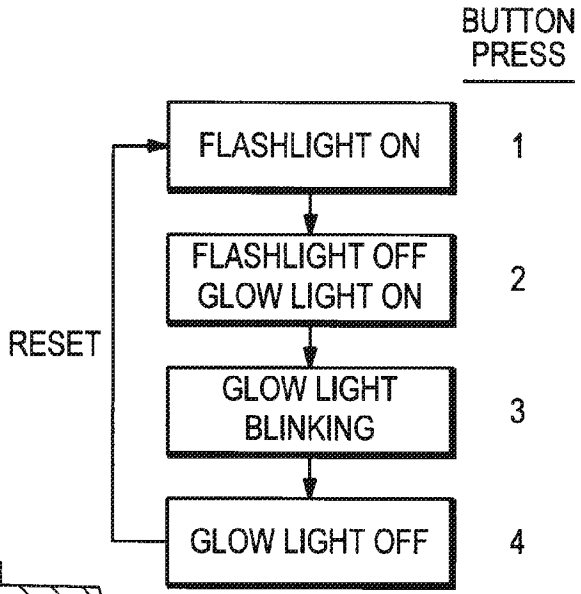
FIG. 5 is a flow-chart illustrating the function of the lighting module upon multiple button presses.

As shown in FIG. 4, button 18 includes an elastomeric top portion that resiliently deforms under downward pressure to force a hard contact against the aligned button 38 of the lighting module 20. Multiple clicks on the button 38 operate control electronics within the module to function as shown in FIG. 5, namely in Table 1:

TABLE 1

| Lighting Device (10) Operation | |
|---|---|
| Button Press 1 → | flashlight LED 34 turned on |
| Button Press 2 → | flashlight LED turned off; glow stick LED 36 turned on |
| Button Press 3 → | glow stick LED 36 flashed intermittently as emergency light |
| Button Press 4 → | glow stick LED 36 turned off |
| Button Press 5 → | flashlight LED 34 turned on |
| . . . | |

Turning lastly to the glow stick operation, and as shown best in FIG. 4, glow stick LED 36 illuminates within the elongate chamber 58 formed within the glow stick housing 14. Light emitted from the LED 36 is internally reflected within the elongate glow stick chamber 58 and scatters out the sidewalls of the housing 14 to form an even glow along its length. The chamber 58 and/or glow stick housing 14 are preferably tapered to facilitate this even glow. The whole operates to better diffuse the illumination along the entire length of the glow stick housing. In this way, the housing may or may not include the hollow interior 58, and may or may not include a solid core (not shown) of a diffusive and/or light scattering material.

In a preferred embodiment, LED 36 gives off a colored light (e.g. red or blue) that matches the colored translucent plastic forming the flashlight housing 12 of the device 10. Glow stick housing 14 includes an O-ring 60 on an outside wall that bears against the inside wall of flashlight housing 12 when the two housings are screw-fitted together. The O-ring 60 helps to prevent water from seeping into the hollow interior 28 of the flashlight housing 12 and thereby adversely affecting the lighting module.

The multipurpose lighting device is useful in that it uses, in its preferred implementation, a single power source and actuator (e.g. button 18) to alternately operate a flashlight and an electronic (as opposed to chemical) glow stick. The lighting device 10 further includes an optional whistle feature 40. In special emergencies, therefore, a single device can thus flash colored light in all directions as the glow stick portion is capable of doing, as well as allow a manual sound alarm (e.g. whistle).

Figure 6:
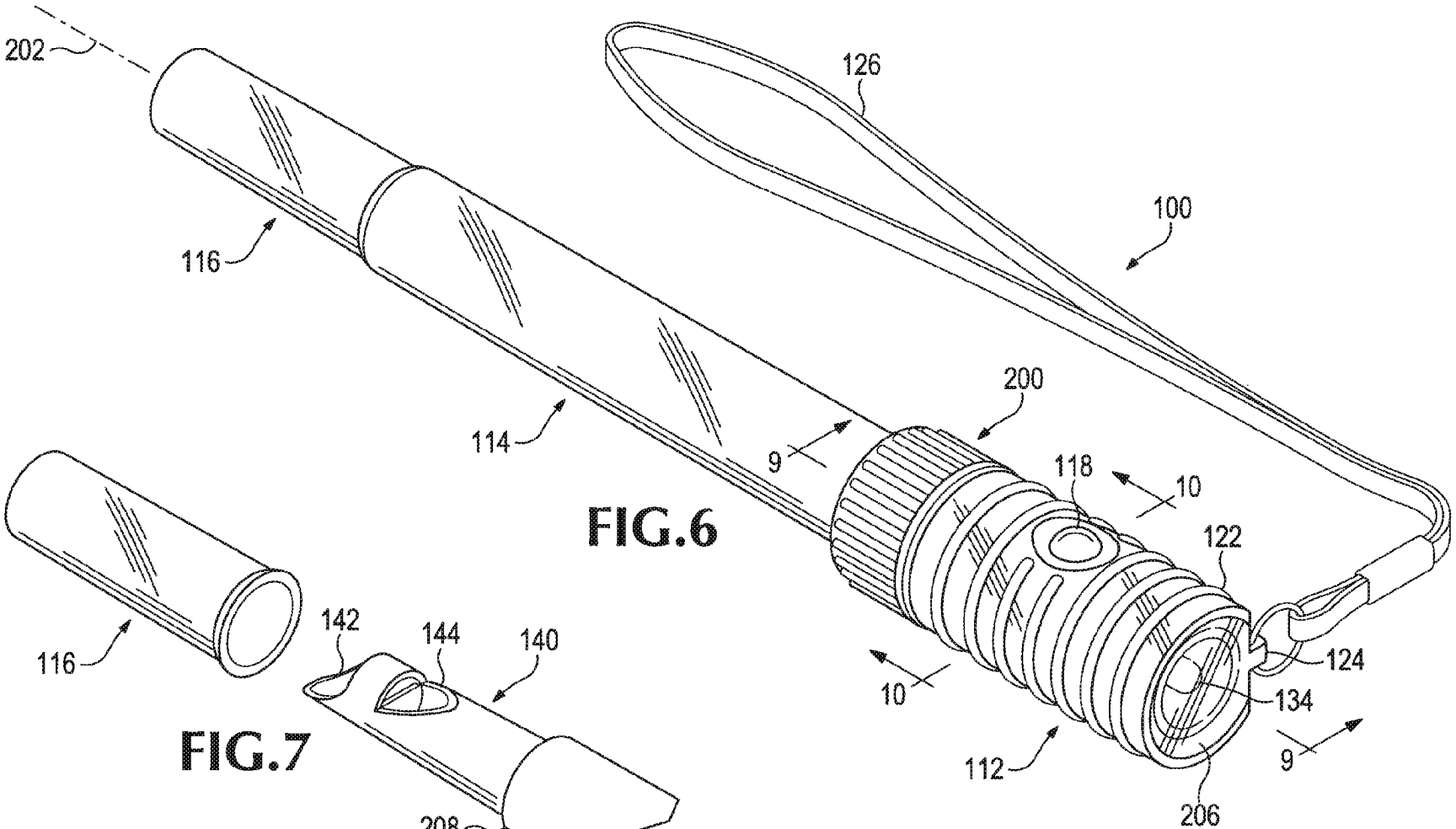
FIG. 6 is a perspective view of a waterproof version of a lighting device implemented according to a preferred embodiment of the invention.

FIG. 6 illustrates a lighting device 100 that has been implemented with further waterproofing features according to a preferred embodiment of the invention. Device 100 is comprised of an elongated assembly having a unitary module housing 112 at a first end of the lighting device 100, an elongated portion 114, a water-tight interface 200 coupled between housing 112 and elongated portion 114, and an end cap 116 adjacent an opposite end of the elongated portion 114. All elements are defined along a long axis 202 of the lighting device 100.

Unitary module housing 112 has generally circumferential side walls 204 surrounding the long axis 202 and a transparent face 206 intersected by the long axis (FIG. 9) at a terminal end of device 100. In a preferred embodiment of the invention, side walls 204 and transparent face 206 are integrated together to form a unitary body 112 with no gaps or seams between the parts to allow intrusion of water therebetween. This may be accomplished by injection molding the side walls 204 and transparent face 206 together into a single piece of plastic of sufficient thickness so as to harden the housing 112 from impact and high water pressure.

A button 118 is defined on a surface of the unitary module housing 112 and interfaces with a button 138 on a lighting module 120 (FIG. 8) as will be described further below. The unitary module housing includes multiple ribs 122 running about the circumferential side walls 204 of the housing 112. A flange 124 is fixed at an end of the unitary module housing 112 and couples with a detachable wrist strap 126.

Figure 7:
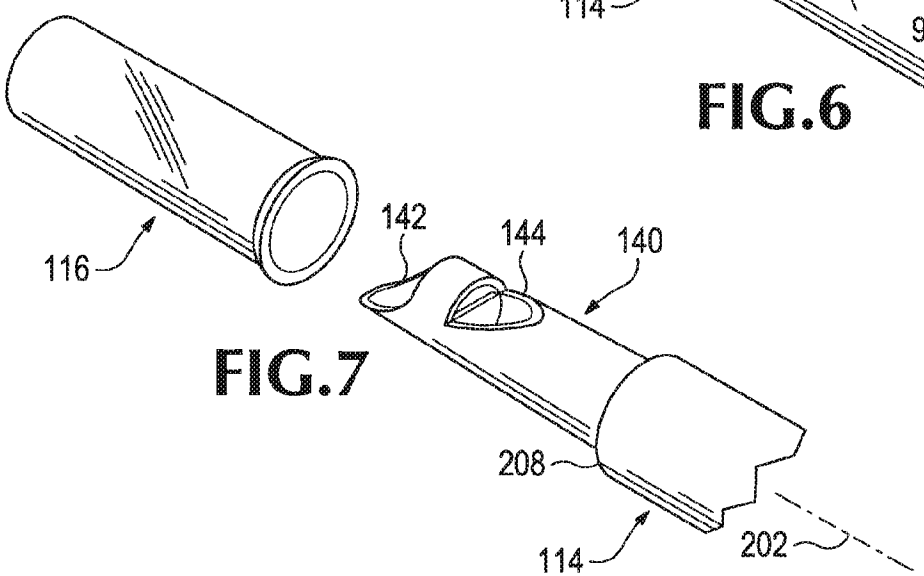
FIG. 7 is a partially exploded view of a terminal end of the lighting device of FIG. 6 showing the whistle-end separated from the cap.

FIG. 7 illustrates an opposite end of the elongated portion 114 defining an alternative whistle feature. FIG. 7 shows the end cap 116 removed from the end 208 of the elongated portion 114 of lighting device 100. A whistle 140 extends axially from the end 208 and includes a mouthpiece opening 142 and whistle opening 144 separated by a shaped baffle (not shown) that completes the whistle. An interior wall (not shown) defined at end 208 separates whistle 140, and particularly the internal cavity therein, from a hollow interior of the elongated portion 114 so as to prevent intrusion of water into the elongated portion 114. This interior wall is preferably transparent or translucent so as to admit light therethrough into the whistle portion 140 from a light source installed within the lighting device 100. As will be appreciated, the multipurpose lighting device 100 includes a flashlight function, a lantern or glow stick function, and can also include a whistle function. The device thus provides a useful multipurpose tool for emergencies or just general use.

Figure 8:
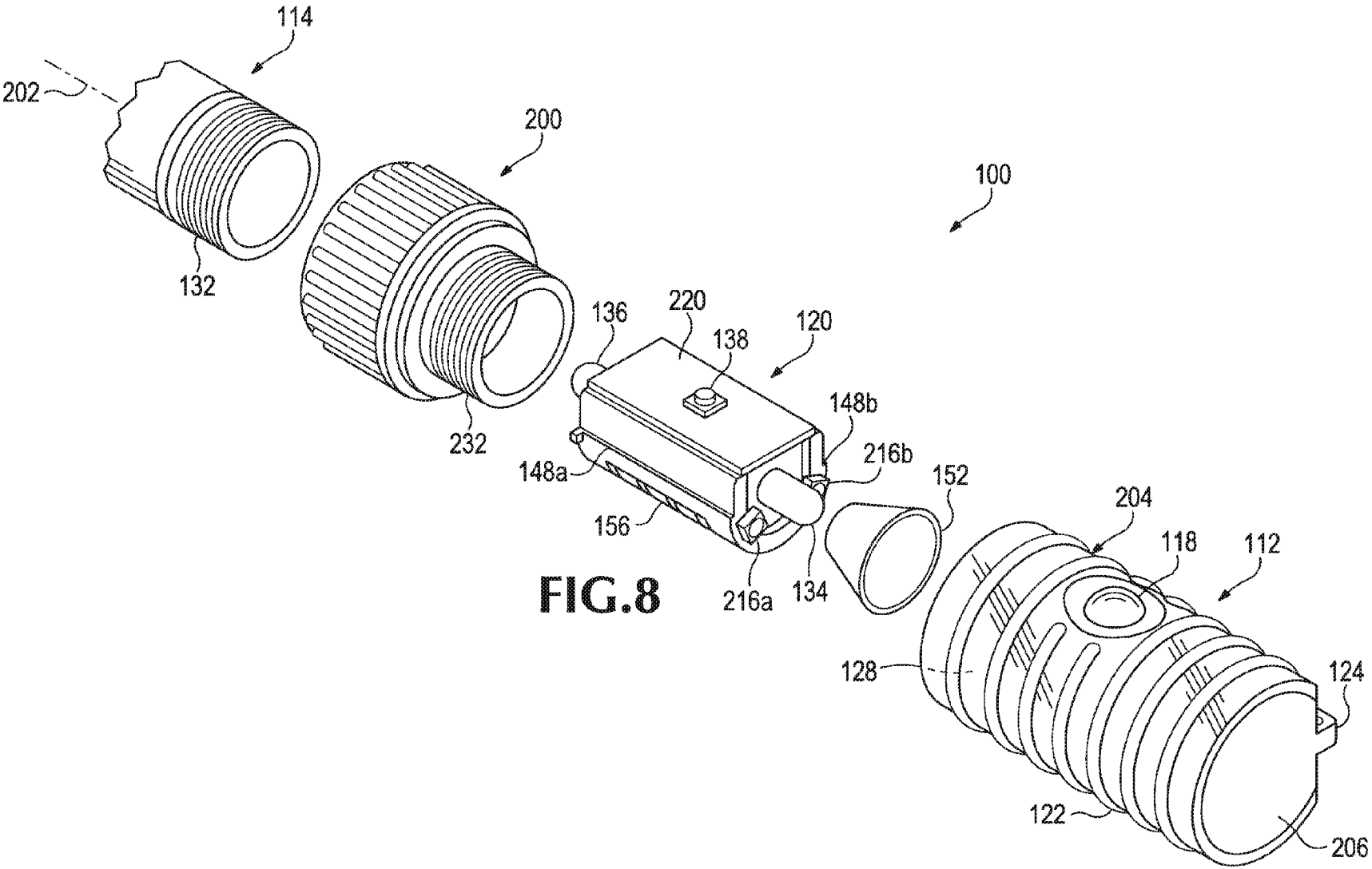
FIG. 8 is a perspective view of a head-end of the lighting device of FIG. 6 shown in exploded view so that all components are illustrated.

FIG. 8 illustrates in exploded perspective view the operative end of the lighting device 100. As illustrated in FIG. 8, the unitary module housing 112 defines a water-tight chamber 128 into which a lighting module 120 is installed. Female threads 130 (FIG. 9) formed on the inside walls of the hollow interior 128 mate with male threads on a threaded portion 232 formed on a proximal end of the water-tight interface 200, thereby enclosing the interior 128 and fixing the lighting module 120 within the lighting device 100.

The lighting module 120 includes a first light source, shown by flashlight LED 134, and a second light source, shown by glow stick LED 136, positioned on opposite ends of lighting module 120. Both light sources 134, 136 are actuated by a button 138 formed on the lighting module that, itself, is aligned with and actuated by the button 118 formed on the unitary module housing 112. Housing button 118 is configured to resiliently deform under downward pressure to force a hard contact against the aligned module button 138. A circuit board 220 interfaces with button 138 and is configured to implement various lighting functions as detailed below.

Figure 9:
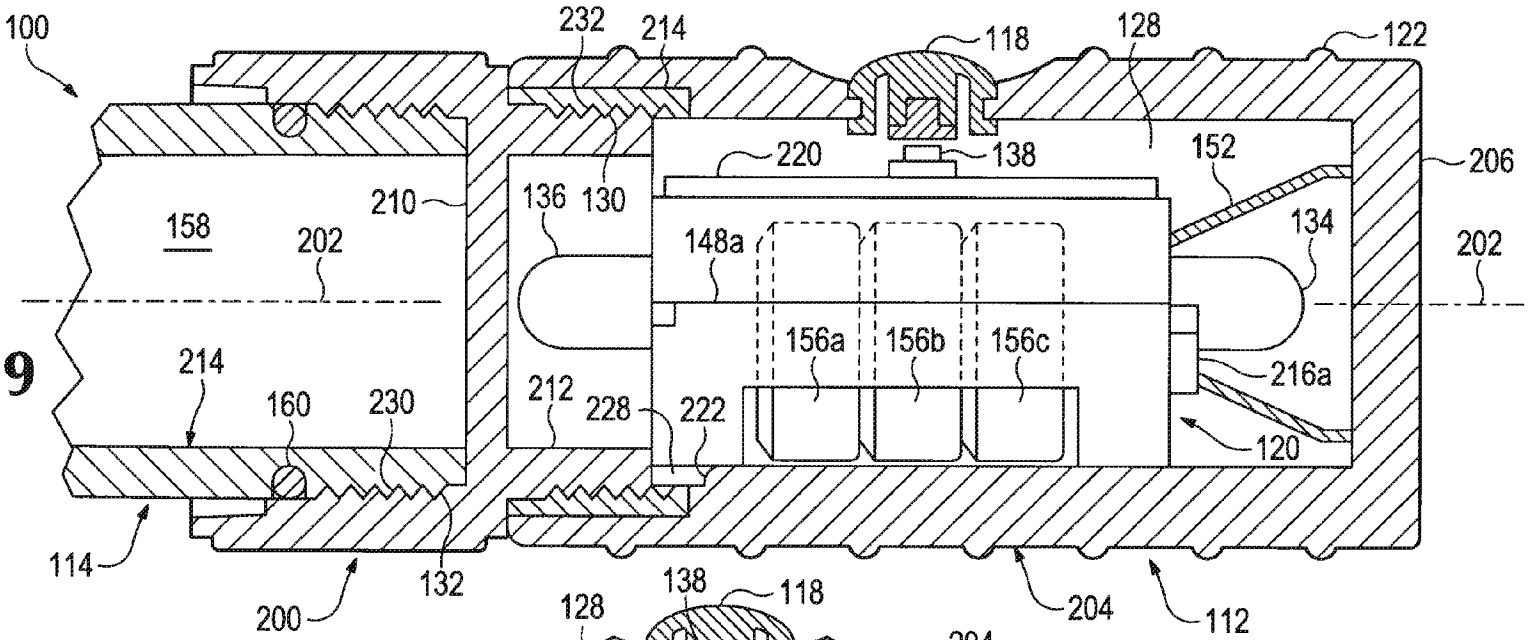
FIG. 9 is a side-section view taken along line 9-9 in FIG. 6 illustrating the lighting module installed within the body of the lighting device of FIG. 1.
Figure 10:
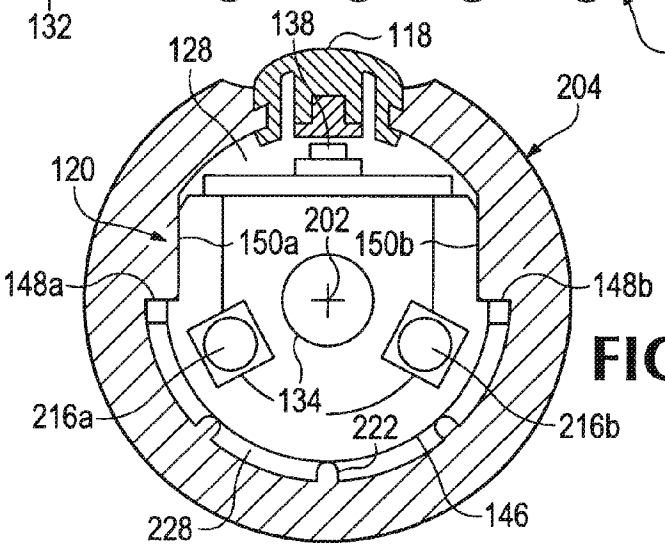
FIG. 10 is a front-section view taken along line 10-10 in FIG. 1 illustrating the lighting module installed within the body of the multipurpose lighting device of FIG. 6.

FIG. 9 shows the lighting module 120 installed within the elongated assembly of lighting device 100, and specifically within the water-tight chamber 128 within the unitary module housing 112. The lighting module 120 is positioned within the water-tight chamber 128 so that the first light source 134 is adjacent to and is configured to project light out the transparent face 206 in a first direction along the long axis 202. The second light source 136 is configured to illuminate along an elongated portion 114 of the elongated assembly, where the elongated portion 114 extends from the water-tight chamber 128 in a second direction along the long axis 202 of the elongated assembly opposite from the first direction, and out the translucent circumferential sides 214 of the elongated portion 114. Button 138 is configured to selectively alternate between the first and second lighting sources 134, 136.

Unitary module housing 112 is shown with circumferential side walls 204, a closed end capped by transparent face 206, and an opposed open end adjacent LED 136 forming the bounds of the water-tight chamber 128. A transparent wall 210 is formed interiorly of the interface 200 to thereby form a bound of chamber 128 when the interface 200 is coupled with the unitary module housing 112. Proximal circumferential inner walls 212 extend toward and contact a surface of module 120 to both fix the module within chamber 128 and surround the second lighting source 136.

The water-tight interface 200 is coupled within the open end of the module housing and is interposed between the module housing 112 and the elongated portion 114 of the lighting device 100. Interface 200 includes a threaded portion 232 formed on an exterior circumference of a first end and a threaded portion 230 formed on an interior circumference of a second end of the interface 200. The first end is mated with complementary threaded portions 130 formed adjacent the open end of the module housing 112, and the second end is mated with complementary threaded portions 132 formed on the elongated portion 114 of the elongated assembly.

In a preferred embodiment, a diameter of the exterior circumference threaded portion 232 is equal to a diameter of the treaded portion 230 on the interior circumference of the second end. In this way, the interface 200 may be removed from the assembly of lighting device 100 so that the elongated portion 114 directly couples to the unitary module housing 112. That is, threads 132 defined exteriorly of the elongated portion 112 mate with complementary threads 130 formed interiorly within the unitary module housing 112.

FIG. 9 also shows a reinforcement member 214 affixed about the open end of the module housing 112. In a preferred implementation, member 214 includes a metal reinforcement ring embedded interiorly within cavity 128, and on an inner surface of housing 112, and is configured to couple with the threads 232 of water-tight interface 200 via threads 130 formed within the metal ring.

The lighting device 100 may further include a supplemental light source positioned on the lighting module 120 offset to the long axis 202 of the elongated assembly. In a preferred embodiment, the supplemental light source includes at least two LEDS, such as supplemental light sources 216*a*, 216*b*, spaced from one another about the long axis 202 of the elongated assembly. As shown, supplemental light sources 216*a*, 216*b* are located on a surface of the module facing the transparent face 206 and adjacent first light source 134, are positioned on lighting module 120 equally offset to the long axis 202 of the elongated assembly, and are configured to be activated together with the second light source 136. Supplemental lights 216*a*, 216*b* may be colored LEDs that are matched with LED 136 so that a glow of matching colors is effused through elongated portion 114 and through at least a front part of housing 112.

Turning to FIGS. 4 and 5, the lighting module 120 is shown installed within the housing 112 of the device 100. Module 120 includes a rounded lower end 146 terminating in elongate ridges 148*a*, 148*b* running the length of the module. Complementary molded portions 150*a*, 150*b* formed on inside walls of the cavity 128 are slidingly engaged with the ridges 148*a*, 148*b* when the lighting module 120 is installed. The cavity 128 of the flashlight housing is thus shaped by the molded portions 150*a*, 150*b* and by the dimensions of the cavity to locate the lighting module at a specific point so that (a) the lighting module button 138 is aligned with the button 118 formed on the outside of the flashlight module 112, and (b) the flashlight LED 134 inserts properly within a conical reflector 152 so that the light may be focused and projected outward through a the transparent face 206 of the unitary module housing 112.

A power source 156—such as batteries 156*a*, 156*b*, and 156*c*—is installed within the lighting module 120 to power the LEDs 134, 136, 216*a*, 216*b* and electronics necessary to selectively actuate the lights according to the flowchart of FIG. 5. The power source 156 is disposed between the first light source 134 and the second light source 136 and is configured within the lighting module 120 to energize the both light sources.

The water-tight cavity 128 may further be configured to include ridges, such as ridge 222, formed on inside lower surfaces of the cavity. The rounded lower end 146 of module 120 rests on these ridges 222 so that the module is generally spaced from contact with the lower portion of cavity 128. This air gap 228 acts to further insulate the module and the heat generated therefrom so that the housing 112 is protected from temperature differentials when used in extreme conditions.

As shown in FIG. 9, button 118 includes an elastomeric top portion that resiliently deforms under downward pressure to force a hard contact against the aligned button 138 of the lighting module 120. Multiple clicks on the button 138 operate control electronics within the module to function as shown in FIG. 5, namely in Table 2:

TABLE 2

| Lighting Device (100) Operation | |
|---|---|
| Button Press 1 → | flashlight LED 134 turned on |
| Button Press 2 → | flashlight LED turned off; glow stick LED 136 (and, optionally, supplemental lights 216a and 216b) turned on |
| Button Press 3 → | glow stick LED 136 (and, optionally, supplemental lights 216a and 216b) flashed intermittently as emergency light |
| Button Press 4 → | glow stick LED 136 (and, optionally, supplemental lights 216a and 216b) turned off |
| Button Press 5 → | flashlight LED 134 turned on |
| Repeat as with Button Press 2 . . . | |

Turning lastly to the glow stick operation, and as shown best in FIG. 9, glow stick LED 136 illuminates within the elongate chamber 158 formed within the elongated portion 114. Light emitted from the LED 136 is internally reflected within the elongate glow stick chamber 158 and scatters out the sidewalls 214 of the elongated portion 114 of lighting device 100 to form an even glow along its length. The chamber 158 and/or elongated portion 114 are preferably tapered to facilitate this even glow. The whole operates to better diffuse the illumination along the entire length of the glow stick housing. In this way, the housing may or may not include the hollow interior 158, and may or may not include a solid core (not shown) of a diffusive and/or light scattering material.

In a preferred embodiment, LED 136 gives off a colored light (e.g. red or blue) that matches the colored translucent plastic forming the unitary housing 112 of the device 100. Glow stick housing 114 includes an O-ring 160 on an outside wall that bears against the inside wall of water-tight interface 200 when the two elements are screw-fitted together. The O-ring 160 helps to prevent water from seeping into the hollow interior 158 of the elongated portion 114 of lighting device 100, or into the cavity 128 if portion 114 is directly coupled to housing 112, and thereby adversely affecting the lighting module 120.

In an alternate aspect of the invention, lighting device 100 comprises a first part defined along a long axis 202 of the lighting device. The first part includes a unitary module housing 112 having circumferential side walls 204 surrounding the long axis 202 and a transparent face 206 intersected by the long axis at a terminal end of the device, where the side walls and transparent face define a cavity 128 within the module housing. A second part of the lighting device includes a substantially translucent body 114 joined coaxially with the first part 112 to form a water-tight seal therebetween and define the cavity substantially within the first part. An integrated module 120, installed substantially coaxially within the cavity 128, comprises a power storage part 156, a first light source 134 configured to direct light in a first direction along an axis 202 of and out the first part 112, and a second light source 136 configured to direct light in a second direction along an axis 202 into the interior 158 of and out the second part 114, wherein the first direction and second direction are coaxial and in opposite directions. The second light source 136 and second part 114 are configured so that the substantially translucent body of the second part is illuminated by the second light source along a length and about a circumference of the second part.

The lighting device 100 further includes a whistle 140 coupled coaxially to one end of the second part 114 and configured, together with the second part, to be illuminated by the second light source 136. A reflecting part 152 is fixed within the cavity 128 at one end of the first part 112 and surrounding the first light source 134 so that the reflecting part 152 focuses light from the first light source 134 and directs it out the first direction through the transparent face 206 of the module housing 112.

The lighting device further includes an interface 200 joined between the first part 112 and the second part 114 of the lighting device and including a transparent wall 210 along the long axis 202 of the elongated assembly and adjacent the second light source 136. A threaded portion 232 is formed on an exterior circumference of a first end of the interface 200 and a threaded portion 230 is formed on an interior circumference of a second end of the interface 200. The first end 232 is mated with a complementary threaded portion 130 formed adjacent an open end of the module housing 112, and the second end 230 mated with a complementary threaded portion 132 formed on an exterior circumference of the second part 114. A metal reinforcement ring 214 is affixed to an inside diameter of the first part adjacent the open end of the module housing 112 and includes the complementary threaded portion 130 to which the interface is joined. In a preferred embodiment, a diameter of the exterior circumference of the first end of the interface 200 is equal to a diameter of the interior circumference of the second end. Further, the second part 114 including an o-ring 160 adjacent the complementary threaded portion 132 formed on the exterior circumference of the second part The multipurpose lighting device is useful in that it uses, in its preferred implementation, a single power source 156 and actuator (e.g. button 118) to alternately operate a flashlight and an electronic (as opposed to chemical) glow stick. The lighting device 100 further includes an optional whistle feature 140. This configuration has the advantage of concentrating all electrical components—including multiple light sources shining in multiple directions, a power source 156, control circuitry 220, and actuator button 138—into a single module 120, and maintaining that module 120 in a single water-tight cavity 128. In special emergencies, therefore, a single device can thus flash colored light in all directions as the glow stick portion is capable of doing, as well as allow a manual sound alarm (e.g. whistle).

Having described and illustrated the principles of the invention in a preferred embodiment thereof, it should be apparent that the invention can be modified in arrangement and detail without departing from such principles. We claim all modifications and variation coming within the spirit and scope of the invention.

What is claimed is:

1. A lighting device comprising:

an elongated assembly forming a water-tight chamber adjacent a first end of the lighting device, the first end including a transparent face along a long axis of the elongated assembly;

a lighting module having a first light source and a second light source positioned on opposite ends of the lighting module, the lighting module positioned within the water-tight chamber so that the first light source is adjacent to and is configured to project light out the transparent face in a first direction along the long axis of the elongated assembly, wherein the elongated assembly includes a unitary module housing having circumferential side walls, a closed end, and an opposed open end forming bounds of the chamber, the closed end including the transparent face through which light from the first light source is projected;

the second light source configured to illuminate along an elongated portion of the elongated assembly, said elongated portion extending from the water-tight chamber in a second direction along the long axis of the elongated assembly opposite from the first direction, and out translucent circumferential sides of the elongated portion;

a water-tight interface coupled within the open end of the module housing and interposed on the long axis between the module housing and the elongated portion of the lighting device, said interface including a transparent wall along the long axis of the elongated assembly and adjacent the second light source; and a button on the module for selectively alternating between the first and second light sources.

2. The lighting device of claim 1, further including a reinforcement member affixed about the open end of the module housing and configured to couple with the water-tight interface.

3. The lighting device of claim 1, wherein the water-tight interface includes a threaded portion formed on an exterior circumference of a first end of the interface and a threaded portion formed on an interior circumference of a second end of the interface, the first end mated with a complementary threaded portion formed adjacent the open end of the module housing, and the second end mated with a complementary threaded portion formed on the elongated portion of the elongated assembly.

4. The lighting device of claim 3, wherein a diameter of the exterior circumference of the first end of the interface is equal to a diameter of the interior circumference of the second end.

5. The lighting device of claim 3, further including a metal reinforcement ring affixed about the open end of the module housing, the complementary threaded portion formed adjacent the open end of the module housing being formed within the reinforcement member.

6. The lighting device of claim 1, further including a whistle coupled to a second end of the lighting device and configured to admit light from the second light source therein.

7. The lighting device of claim 1, further including a supplemental light source adjacent the first light source and positioned on the lighting module offset to the long axis of the elongated assembly, said supplemental light sources configured to be activated together with the second light source.

8. The lighting device of claim 7, wherein the supplemental light source includes at least two LEDs spaced from one another about the long axis of the elongated assembly.

9. The lighting device of claim 1, wherein the unitary module housing includes a housing button located on the outside of the housing that aligns with the button on the module so that actuating the housing button also serves to actuate the module button so that the lighting device is operated.

10. The lighting device of claim 9, wherein the housing button is configured to resiliently deform under downward pressure to force a hard contact against the aligned button of the lighting module.

11. The lighting device of claim 1, wherein successive actuations of the button operate the device to operate the first light source only, the second light source only, or the second light source in a repeating flash mode.

12. The lighting device of claim 1, further including a power source configured within the lighting module to energize the first light source and second light source.

13. The lighting device of claim 12, wherein the power source is disposed between the first light source and the second light source.

14. A lighting device comprising:

a first part defined along a long axis of the lighting device and including a unitary module housing having circumferential side walls surrounding the long axis and a transparent face intersected by the long axis at a terminal end of the device, said side walls and transparent face defining a cavity within the module housing;

a second part having a substantially translucent body joined coaxially with the first part to form a water-tight seal therebetween and define the cavity substantially within the first part; and an integrated module installed substantially coaxially within the cavity, the module comprising a power storage part, a first light source configured to direct light in a first direction along an axis of and out the first part, and a second light source configured to direct light in a second direction along an axis into the interior of and out the second part, wherein the first direction and second direction are coaxial and in opposite directions, wherein the second light source and second part are configured so that the substantially translucent body of the second part is illuminated by the second light source along a length and about a circumference of the second part.

15. The lighting device of claim 14, further including a whistle coupled coaxially to one end of the second part and configured, together with the second part, to be illuminated by the second light source.

16. The lighting device of claim 14, further including a reflecting part fixed within the cavity at one end of the first part and surrounding the first light source so that the reflecting part focuses light from the first light source and directs it out the first direction through the transparent face of the module housing.

17. The lighting device of claim 14, further including:

an interface joined between the first part and the second part of the lighting device and including a transparent wall along the long axis of the elongated assembly and adjacent the second light source;

threaded portion formed on an exterior circumference of a first end of the interface and a threaded portion formed on an interior circumference of a second end of the interface, the first end mated with a complementary threaded portion formed adjacent an open end of the module housing, and the second end mated with a complementary threaded portion formed on an exterior circumference of the second part; and a metal reinforcement ring affixed to an inside diameter of the first part adjacent the open end of the module housing and including the complementary threaded portion to which the interface is joined.

18. The lighting device of claim 17, wherein a diameter of the exterior circumference of the first end of the interface is equal to a diameter of the interior circumference of the second end, the second part including an o-ring adjacent the complementary threaded portion formed on the exterior circumference of the second part.

* * * * *